US011717850B2

(12) United States Patent
Pankoke

(10) Patent No.: US 11,717,850 B2
(45) **Date of Patent: *Aug. 8, 2023**

(54) METHOD AND APPARATUS FOR PRODUCING A DECORATIVE WORKPIECE AND WORKPIECE

(71) Applicant: Hymmen GmbH Maschinen-und Anlagenbau, Bielefeld (DE)

(72) Inventor: René Pankoke, Bielefeld (DE)

(73) Assignee: Hymmen GmbH Maschinen-und Anlagenbau, Bielefeld (DE)

( * ) Notice: Subject to any disclaimer, the term of this patent is extended or adjusted under 35 U.S.C. 154(b) by 0 days.

This patent is subject to a terminal disclaimer.

(21) Appl. No.: 17/883,623

(22) Filed: Aug. 9, 2022

(65) Prior Publication Data

US 2022/0379343 A1 Dec. 1, 2022

Related U.S. Application Data

(62) Division of application No. 16/494,308, filed as application No. PCT/EP2018/065737 on Jun. 13, 2018, now Pat. No. 11,511,318.

(30) Foreign Application Priority Data

Jun. 13, 2017 (DE) ..... 10 2017 113 035.7
Jun. 13, 2017 (DE) ..... 10 2017 113 036.5
(Continued)

(51) Int. Cl.
*B44C 5/04* (2006.01)
*B41J 11/00* (2006.01)
(Continued)

(52) U.S. Cl.
CPC ..... *B05D 3/12* (2013.01); *B05D 3/002* (2013.01); *B05D 3/0486* (2013.01); *B05D 3/067* (2013.01);
(Continued)

(58) Field of Classification Search
CPC ..... B05D 3/12; B05D 3/002; B05D 3/0486; B05D 3/067; B05D 5/02; B05D 7/584;
(Continued)

(56) References Cited

U.S. PATENT DOCUMENTS 692,701 A 2/1902 Burner
3,308,227 A 3/1967 Power et al.
(Continued)

FOREIGN PATENT DOCUMENTS

AT 387621 2/1989
CA 2406991 11/2001
(Continued)

OTHER PUBLICATIONS

Notice of Allowance dated Oct. 3, 2022 from US Patent and Trademark Office Re. U.S. Appl. No. 16/758,056. (38 pages).
(Continued)

*Primary Examiner* — Yaovi M Ameh

(57) ABSTRACT

The inventions relates to a method for producing a decorative workpiece with a structured surface comprising the following steps:

(B) applying a first liquid lacquer having a coarse structuring over the entire surface, wherein a difference in thickness between thicker regions and thinner regions is at least 50 μm, in particular at least 100 μm;

(E) applying a second liquid, at least partially transparent lacquer for producing a fine structuring in some regions.

Furthermore, an apparatus for performing the method and a workpiece produced by the method are claimed.

12 Claims, 3 Drawing Sheets

(30) Foreign Application Priority Data

| | | |
|---|---|---|
| Feb. 19, 2018 | (EP) | 18157511 |
| Mar. 14, 2018 | (EP) | 18161725 |
| Mar. 16, 2018 | (EP) | 18162382 |
| Apr. 19, 2018 | (EP) | 18168263 |

(51) Int. Cl.

| | |
|---|---|
| ***B05D 7/00*** | (2006.01) |
| ***B05D 3/12*** | (2006.01) |
| ***B05D 3/06*** | (2006.01) |
| ***B05D 5/02*** | (2006.01) |
| ***B41M 7/00*** | (2006.01) |
| ***B44C 3/02*** | (2006.01) |
| ***B41F 23/08*** | (2006.01) |
| ***B41M 3/06*** | (2006.01) |
| ***B41M 5/00*** | (2006.01) |
| ***B05D 3/00*** | (2006.01) |
| ***B05D 3/04*** | (2006.01) |
| ***B41J 2/21*** | (2006.01) |
| ***B41J 3/407*** | (2006.01) |
| *B44F 1/02* | (2006.01) |
| *B44F 9/02* | (2006.01) |
| *E04F 13/08* | (2006.01) |
| *E04F 15/10* | (2006.01) |
| *B05D 5/06* | (2006.01) |
| *B44F 11/04* | (2006.01) |

(52) U.S. Cl.

CPC ..... *B05D 5/02* (2013.01); *B05D 7/584* (2013.01); *B41F 23/08* (2013.01); *B41J 2/2114* (2013.01); *B41J 3/407* (2013.01); *B41J 11/002* (2013.01); *B41J 11/0015* (2013.01); *B41M 3/06* (2013.01); *B41M 5/0047* (2013.01); *B41M 7/009* (2013.01); *B41M 7/0027* (2013.01); *B41M 7/0045* (2013.01); *B41M 7/0054* (2013.01); *B41M 7/0081* (2013.01); *B44C 3/02* (2013.01); *B05D 5/061* (2013.01); *B44C 5/04* (2013.01); *B44F 1/02* (2013.01); *B44F 9/02* (2013.01); *B44F 11/04* (2013.01); *E04F 13/0873* (2013.01); *E04F 15/107* (2013.01)

(58) Field of Classification Search

CPC ..... B05D 5/061; B41F 23/08; B41J 11/002; B41M 5/0047; B41M 7/0027; B41M 7/0045; B41M 7/0054; B41M 7/0081; B41M 3/06; B44C 3/02; B44C 5/04; B44F 1/02; B44F 9/02; E04F 13/0873; E04F 15/107

See application file for complete search history.

(56) References Cited

U.S. PATENT DOCUMENTS

| | | | | |
|---|---|---|---|---|
| 3,580,768 | A | 5/1971 | Kukla | |
| 3,676,963 | A | 7/1972 | Rice et al. | |
| 4,439,480 | A | 3/1984 | Sachs et al. | |
| 4,513,299 | A | 4/1985 | Lee et al. | |
| 4,557,778 | A | 12/1985 | Held | |
| 4,668,765 | A | 5/1987 | Drawert et al. | |
| 5,178,928 | A | 1/1993 | Goto et al. | |
| 5,306,783 | A | 4/1994 | Kirchgaessner et al. | |
| 5,358,737 | A | 10/1994 | Muees et al. | |
| 5,779,779 | A | 7/1998 | Jolly | |
| 6,120,845 | A | 9/2000 | Pease | |
| 6,150,009 | A | 11/2000 | Stecker | |
| 6,193,361 | B1 | 2/2001 | Wen | |
| 6,354,686 | B1 | 3/2002 | Tanaka et al. | |
| 6,375,777 | B1 | 4/2002 | Sjolin et al. | |
| 6,589,357 | B1 | 7/2003 | Wandres | |
| 6,621,087 | B1 | 9/2003 | Bisges et al. | |
| 6,830,305 | B1 | 12/2004 | Takizawa | |
| 6,927,014 | B1 | 8/2005 | Figov | |
| 7,001,016 | B2 | 2/2006 | Baxter et al. | |
| 9,266,382 | B2 | 2/2016 | Schacht et al. | |
| 11,141,759 | B2 | 10/2021 | Pankokc | |
| 11,511,318 | B2 * | 11/2022 | Pankoke | B05D 7/584 |
| 2002/0018085 | A1 | 2/2002 | Asauchi | |
| 2002/0061389 | A1 | 5/2002 | Brooker et al. | |
| 2003/0011651 | A1 | 1/2003 | Rupprecht et al. | |
| 2003/0152715 | A1 | 8/2003 | Beck et al. | |
| 2003/0167717 | A1 | 9/2003 | Garcia | |
| 2004/0028830 | A1 | 2/2004 | Bauer | |
| 2004/0048171 | A1 | 3/2004 | Grabber et al. | |
| 2004/0086678 | A1 | 5/2004 | Chen et al. | |
| 2004/0241416 | A1 | 12/2004 | Tian et al. | |
| 2005/0103182 | A1 | 5/2005 | Spurgeon | |
| 2005/0255249 | A1 | 11/2005 | Schlatterbeck et al. | |
| 2006/0075917 | A1 * | 4/2006 | Edwards | B41J 11/00214 101/483 |
| 2006/0130421 | A1 | 6/2006 | Nollet et al. | |
| 2006/0163371 | A1 | 7/2006 | Veil | |
| 2006/0209108 | A1 | 9/2006 | Hamazaki et al. | |
| 2006/0238554 | A1 | 10/2006 | Hosono | |
| 2007/0160790 | A1 | 7/2007 | Kaneko | |
| 2007/0235410 | A1 | 10/2007 | Wong et al. | |
| 2007/0283648 | A1 | 12/2007 | Chen | |
| 2007/0296790 | A1 | 12/2007 | Nakazawa et al. | |
| 2008/0074482 | A1 | 3/2008 | Makuta et al. | |
| 2008/0081116 | A1 | 4/2008 | Makuta et al. | |
| 2008/0084466 | A1 | 4/2008 | Makuta et al. | |
| 2008/0176039 | A1 | 7/2008 | Chen et al. | |
| 2008/0187680 | A1 | 8/2008 | Kawakami et al. | |
| 2008/0241481 | A1 | 10/2008 | Tokumoto et al. | |
| 2008/0280028 | A1 | 11/2008 | Albrecht et al. | |
| 2009/0225143 | A1 | 9/2009 | Fukui | |
| 2009/0246365 | A1 | 10/2009 | Ito et al. | |
| 2010/0092688 | A1 | 4/2010 | Serbutoviez et al. | |
| 2011/0067731 | A1 | 3/2011 | Satoh et al. | |
| 2011/0157272 | A1 * | 6/2011 | Ikehata | B41J 29/38 347/16 |
| 2012/0015107 | A1 | 1/2012 | Schacht et al. | |
| 2013/0065024 | A1 | 3/2013 | Aruga | |
| 2013/0101796 | A1 | 4/2013 | Arzt et al. | |
| 2013/0286088 | A1 | 10/2013 | Ryberg et al. | |
| 2013/0286095 | A1 | 10/2013 | Wada et al. | |
| 2013/0341532 | A1 | 12/2013 | Lee et al. | |
| 2014/0017452 | A1 * | 1/2014 | Pervan | B44C 1/24 427/510 |
| 2014/0343687 | A1 | 11/2014 | Jennissen | |
| 2016/0009932 | A1 | 1/2016 | Jang et al. | |
| 2016/0114619 | A1 | 4/2016 | Schacht et al. | |
| 2016/0205965 | A1 | 7/2016 | Elejalde et al. | |
| 2016/0238774 | A1 | 8/2016 | Koike et al. | |
| 2016/0297223 | A1 | 10/2016 | Langenscheidt et al. | |
| 2016/0332479 | A1 | 11/2016 | Clement | |
| 2017/0081522 | A1 | 3/2017 | Adam et al. | |
| 2017/0333936 | A1 | 11/2017 | Gibson et al. | |
| 2018/0056671 | A1 | 3/2018 | Boniface | |
| 2020/0016627 | A1 | 1/2020 | Pankoke | |
| 2020/0016629 | A1 | 1/2020 | Pankoke | |
| 2020/0023662 | A1 | 1/2020 | Pankoke | |
| 2020/0040799 | A1 | 2/2020 | Won | |
| 2020/0346246 | A1 | 11/2020 | Pankoke | |
| 2020/0346395 | A1 | 11/2020 | Pankoke | |
| 2020/0346484 | A1 | 11/2020 | Pankoke | |
| 2020/0368777 | A1 | 11/2020 | Pankoke | |
| 2021/0268542 | A1 | 9/2021 | Pankoke | |
| 2021/0394232 | A1 | 12/2021 | Pankoke | |
| 2022/0379344 | A1 | 12/2022 | Pankoke | |
| 2023/0144445 | A1 | 5/2023 | Pankokc | |

FOREIGN PATENT DOCUMENTS

| | | |
|---|---|---|
| CA | 2568440 | 12/2005 |
| CN | 1166386 | 12/1997 |
| CN | 1572380 | 2/2005 |

(56) References Cited

FOREIGN PATENT DOCUMENTS

| | | | |
|---|---|---|---|
| CN | 1653390 | 8/2005 | |
| CN | 101116987 | 2/2008 | |
| CN | 101301821 | 11/2008 | |
| CN | 101314981 | 12/2008 | |
| CN | 101342844 | 1/2009 | |
| CN | 102089088 | 6/2011 | |
| CN | 102256806 | 11/2011 | |
| CN | 102834188 | 12/2012 | |
| CN | 103035983 | 4/2013 | |
| CN | 103192656 | 7/2013 | |
| CN | 103209770 | 7/2013 | |
| CN | 103737464 | 4/2014 | |
| CN | 104039368 | 9/2014 | |
| CN | 105377521 | 3/2016 | |
| CN | 105835589 | 8/2016 | |
| CN | 207211033 | 4/2018 | |
| CN | 109395925 | 3/2019 | |
| DE | 3107798 | 9/1982 | |
| DE | 3331391 | 3/1985 | |
| DE | 69119743 | 1/1997 | |
| DE | 19532819 | 3/1997 | |
| DE | 19810455 | 9/1999 | |
| DE | 69709984 | 9/2002 | |
| DE | 10316695 | 10/2004 | |
| DE | 60009141 | 10/2004 | |
| DE | 60007560 | 12/2004 | |
| DE | 69732819 | 4/2006 | |
| DE | 102006003798 | 7/2007 | |
| DE | 102006042063 | 3/2008 | |
| DE | 102007019871 | 10/2008 | |
| DE | 102007055053 | 5/2009 | |
| DE | 102008024149 | 12/2009 | |
| DE | 102009004482 | 7/2010 | |
| DE | 102009043812 | 3/2011 | |
| DE | 102009044802 | 12/2011 | |
| DE | 102009044802 A1 * | 12/2011 | ..... B41J 11/002 |
| DE | 102010052518 | 5/2012 | |
| DE | 102015107259 | 11/2016 | |
| DE | 102015110236 | 12/2016 | |
| DE | 102015110268 | 12/2016 | |
| DE | 102016120878 | 5/2017 | |
| DE | 102017113035 | 12/2018 | |
| DE | 4421559 | 5/2020 | |
| EP | 0019221 | 11/1980 | |
| EP | 0197267 | 10/1986 | |
| EP | 0210620 | 2/1987 | |
| EP | 0553421 | 8/1993 | |
| EP | 0372097 | 6/1996 | |
| EP | 0719647 | 7/1996 | |
| EP | 0810039 | 12/1997 | |
| EP | 0827838 | 3/1998 | |
| EP | 1101542 | 5/2001 | |
| EP | 1294578 | 3/2003 | |
| EP | 1384595 | 1/2004 | |
| EP | 1449667 | 8/2004 | |
| EP | 1454763 | 9/2004 | |
| EP | 1482085 | 12/2004 | |
| EP | 1652686 | 5/2006 | |
| EP | 1685974 | 8/2006 | |
| EP | 1728639 | 12/2006 | |
| EP | 1872959 | 1/2008 | |
| EP | 1902849 | 3/2008 | |
| EP | 1911594 | 4/2008 | |
| EP | 1952998 | 8/2008 | |
| EP | 2042335 | 4/2009 | |
| EP | 2050514 | 4/2009 | |
| EP | 1290290 | 1/2010 | |
| EP | 2174772 | 4/2010 | |
| EP | 2181860 | 5/2010 | |
| EP | 2251205 | 11/2010 | |
| EP | 2280130 | 2/2011 | |
| EP | 2301762 | 3/2011 | |
| EP | 2308682 | 4/2011 | |
| EP | 2418019 | 2/2012 | |
| EP | 2786807 | 10/2014 | |
| EP | 2857221 | 4/2015 | |
| EP | 2873535 | 5/2015 | |
| EP | 2873536 | 5/2015 | |
| EP | 2883712 | 6/2015 | |
| EP | 3090882 | 11/2016 | |
| EP | 3109056 | 12/2016 | |
| EP | 2555878 | 12/2017 | |
| EP | 3415316 | 12/2018 | |
| EP | 3415317 | 12/2018 | |
| EP | 3415318 | 12/2018 | |
| EP | 3415319 | 12/2018 | |
| EP | 3466677 | 4/2019 | |
| EP | 2313281 | 9/2020 | |
| EP | 3875248 | 9/2021 | |
| ES | 370796 | 1/1972 | |
| ES | 1018178 | 1/1992 | |
| ES | 2340456 | 6/2010 | |
| ES | 2349527 | 1/2011 | |
| ES | 2586981 | 10/2016 | |
| FR | 2936965 | 4/2010 | |
| FR | 2946959 | 12/2010 | |
| GB | 1405643 | 9/1975 | |
| JP | 59-169575 | 9/1984 | |
| JP | 06-270372 | 9/1994 | |
| JP | 09323434 | 12/1997 | |
| JP | 2003-285000 | 10/2003 | |
| JP | 2004-042548 | 2/2004 | |
| JP | 2004-134760 | 4/2004 | |
| JP | 2008-093910 | 4/2008 | |
| JP | 2008-246993 | 10/2008 | |
| JP | 2010-069684 | 4/2010 | |
| JP | 2011-173091 | 9/2011 | |
| JP | 2017-200740 | 11/2017 | |
| KR | 1020030083066 | 10/2003 | |
| KR | 1020060004828 | 1/2006 | |
| KR | 1020090066585 | 6/2009 | |
| KR | 2010-0120434 | 11/2010 | |
| RU | 2005132339 | 4/2007 | |
| WO | WO 90/015673 | 12/1990 | |
| WO | WO 98/08687 | 3/1998 | |
| WO | WO 99/012736 | 3/1999 | |
| WO | WO 99/67227 | 12/1999 | |
| WO | WO 00/30856 | 6/2000 | |
| WO | WO 01/47718 | 7/2001 | |
| WO | WO 02/08346 | 1/2002 | |
| WO | WO 02/033740 | 4/2002 | |
| WO | WO 02/068189 | 9/2002 | |
| WO | WO 2003/099456 | 12/2003 | |
| WO | WO 2005/116361 | 12/2005 | |
| WO | WO 2006/037644 | 4/2006 | |
| WO | WO 2006/080362 | 8/2006 | |
| WO | WO 2007/026172 | 3/2007 | |
| WO | WO 2007/088245 | 8/2007 | |
| WO | WO 2008/089021 | 7/2008 | |
| WO | WO 2008/110883 | 9/2008 | |
| WO | WO 2008/132126 | 11/2008 | |
| WO | WO 2010/070485 | 6/2010 | |
| WO | WO 2010/079014 | 7/2010 | |
| WO | WO 2011/064075 | 6/2011 | |
| WO | WO 2011/126148 | 10/2011 | |
| WO | WO 2014/184418 | 11/2014 | |
| WO | WO 2015/078449 | 6/2015 | |
| WO | WO 2016/014617 | 1/2016 | |
| WO | WO 2016/142510 | 9/2016 | |
| WO | WO 2017/204361 | 11/2017 | |
| WO | WO 2018/069874 | 4/2018 | |
| WO | WO 2018/229170 | 12/2018 | |
| WO | WO 2020/039361 | 2/2020 | |

OTHER PUBLICATIONS

Official Action dated Oct. 13, 2022 from the US Patent and Trademark Office Re. U.S. Appl. No. 16/865,356. (65 pages).

"Barberan Industrial Solutions Since 1929", Barberan, English Transaltion, 10 P., Sep. 25, 2019.

"Darstellung Hilfslinie [Appearance Guideline]", 1 P.

"Dibujo TEC 1 and TEC 2", 1 P.

(56) References Cited

OTHER PUBLICATIONS

"Widerspruchsbegruendung and it's machine-translation in English".
"Yupo Corporation, product information", retrieved from the internet on Feb. 25, 2022.
Final Official Action dated Feb. 7, 2022 from US Patent and Trademark Office Re. U.S. Appl. No. 16/494,308. (17 pages).
Final Official Action dated Feb. 18, 2021 From the US Patent and Trademark Office Re. U.S. Appl. No. 16/494,307. (21 Pages).
Final Official Action dated Mar. 18, 2022 from US Patent and Trademark Office Re. U.S. Appl. No. 16/865,355. (24 pages).
International Search Report and Written Opinion dated Sep. 3, 2018 From the International Searching Authority Re. Application No. PCT/EP2018/065731 and its English Translation. (16 Pages).
International Search Report and Written Opinion dated Sep. 5, 2018 From the International Searching Authority Rc. Application No. PCT/EP2018/065737 and its English Translation. (14 Pages).
International Search Report and Written Opinion dated Aug. 31, 2018 From the International Searching Authority Re. Application No. PCT/EP2018/065734 and its English Translation. (14 Pages).
International Search Report and Written Opinion dated Aug. 31, 2018 From the International Searching Authority Re. Application No. PCT/EP2018/065738 and its English Translation. (13 Pages).
Notice of Allowance dated Jun. 7, 2022 from US Patent and Trademark Office Re. U.S. Appl. No. 16/865,355. (9 pages).
Notice of Allowance dated Apr. 20, 2022 from US Patent and Trademark Office Re. U.S. Appl. No. 16/494,309. (16 pages).
Notice of Allowance dated Apr. 21, 2022 from US Patent and Trademark Office Re. U.S. Appl. No. 16/494,308. (16 pages).
Notice of Allowance dated Aug. 24, 2022 from US Patent and Trademark Office Re. U.S. Appl. No. 16/494,308. (26 pages).
Notice of Allowance dated May 26, 2021 From the US Patent and Trademark Office Re. U.S. Appl. No. 16/494,307. (7 Pages).
Official Action dated Dec. 8, 2021 from US Patent and Trademark Office Re. U.S. Appl. No. 16/494,309. (62 pages).
Official Action dated Oct. 18, 2021 from the US Patent and Trademark Office Re. U.S. Appl. No. 16/865,355. (56 pages).
Official Action dated Aug. 27, 2020 from the US Patent and Trademark Office Re. U.S. Appl. No. 16/494,307. (26 pages).
Official Action with Third-Party Submission dated Sep. 10, 2021 From the US Patent and Trademark Office Re. U.S. Appl. No. 16/494,308. (50 Pages).
Restriction Official Action dated Jul. 7, 2021 from the US Patent and Trademark Office Re. U.S. Appl. No. 16/865,355. (6 pages).
Restriction Official Action dated Apr. 26, 2021 from the US Patent and Trademark Office Re. U.S. Appl. No. 16/494,308. (6 pages).
Restriction Official Action dated May 27, 2022 from the US Patent and Trademark Office Re. U.S. Appl. No. 16/494,310. (lOpages).
Restriction Official Action dated Jul. 28, 2022 from US Patent and Trademark Office Re. U.S. Appl. No. 16/865,356. (5 pages).
Restriction Official Action dated Jun. 29, 2022 from US Patent and Trademark Office Re. U.S. Appl. No. 17/322,966. (7 pages).
Third Party IDS Submission under 37 CFR 1.290 filed Aug. 3, 2022 From the US Patent and Trademark Office Re. U.S. Appl. No. 17/467,316.(2 Pages).
Third Party IDS Submission under 37 CFR 1.290 filed Nov. 4, 2021 From the US Patent and Trademark Office Re. U.S. Appl. No. 16/865.356.(3 Pages).
Third Party IDS Submission under 37 CFR 1.290 filed Aug. 15, 2022 From the US Patent and Trademark Office Re. U.S. Appl. No. 16/494,310.(2 Pages).
Third Party IDS Submission under 37 CFR 1.290 filed Aug. 15, 2022 From the US Patent and Trademark Office Re. U.S. Appl. No. 17/322,966.(2 Pages).
Third Party IDS Submission under 37 CFR 1.290 filed Oct. 15, 2021 From the US Patent and Trademark Office Re. U.S. Appl. No. 16/865,355.(2 Pages).
Third Party Submission under 37 CFR 1.290 filed Nov. 28, 2021 From the US Patent and Trademark Office Re. U.S. Appl. No. 16/865,358.(3 Pages).
Third Party Submission under 37 CFR 1.290 filed Jan. 29, 2021 From the US Patent and Trademark Office Re. U.S. Appl. No. 16/494,308.(2 Pages).
Third Party Submission under 37 CFR 1.290 filed Jan. 29, 2021 From the US Patent and Trademark Office Re. U.S. Appl. No. 16/494,309.(2 Pages).
Third-Party Submission Under 37 CFR 1.290 filed Jan. 29, 2021 From the US Patent and Trademark Office Re. U.S. Appl. No. 16/494,310. (2 Pages).
USPTO Communication Dated Dec. 1, 2021 RE Third-Party Submission From the US Patent and Trademark Office Re. U.S. Appl. No. 16/865,358.(2 Pages).
USPTO Communication Dated Feb. 3, 2021 RE Third-Party Submission From the US Patent and Trademark Office Re. U.S. Appl. No. 16/494,308.(2 Pages).
USPTO Communication Dated Feb. 3, 2021 RE Third-Party Submission From the US Patent and Trademark Office Re. U.S. Appl. No. 16/494,310.(2 Pages).
USPTO Communication Dated Aug. 8, 2022 RE Third-Party Submission From the US Patent and Trademark Office Re. U.S. Appl. No. 17/467,316.(2 Pages).
USPTO Communication Dated Nov. 10, 2021 RE Third-Party Submission From the US Patent and Trademark Office Re. U.S. Appl. No. 16/865,356.(2 Pages).
USPTO Communication Dated Feb. 11, 2021 RE Third-Party Submission From the US Patent and Trademark Office Re. U.S. Appl. No. 16/494,309.(2 Pages).
USPTO Communication Dated Aug. 17, 2022 RE Third-Party Submission From the US Patent and Trademark Office Re. U.S. Appl. No. 16/494,310.(2 Pages).
USPTO Communication Dated Aug. 17, 2022 RE Third-Party Submission From the US Patent and Trademark Office Re. U.S. Appl. No. 17/322,966.(2 Pages).
USPTO Communication Dated Oct. 25, 2021 RE Third Party Submission From the US Patent and Trademark Office Re. U.S. Appl. No. 16/865,355.(2 Pages).
Baldwin "Bridging the Path to a Silicon Future", IMI 17th Annual Ink Jet Printing Conference, 28 P., Feb. 7, 2008.
Barberan "Auszug Auftragsbestaetigung Brohl Master Curing Primer", Barberan, 3 P., Nov. 15, 2018.
Barberan "Auszug Webseite Wellpappenmaschinentyp", Barberan, 1 P.
Barberan "Barberan Screenshots", Barberan, 4 P., 2020.
Barberan "BIJ-INKJET Modular Digital Printing Systems", Barberan, 7 P., 2020.
Barberan "Catalogues", Barberan, 9 P., Mar. 31, 2020.
Barberan "First Barberan Jetmasters in Germany", Barberan, Machine Translation, 2 P., Mar. 16, 2021.
Barberan "Heads in Machine: Y Positition Offset", Barberan, Jetmaster Series, Screenshot.
Barberan "Jetmaster 360 Printing Software Manual", Barberan, 58 P., Dec. 5, 2017.
Barberan "Jetmaster 360", Barberan, English Translation and Design, 12 P., Sep. 6, 2021.
Barberan "Jetmaster Series A", Barberan, 1 P., 2020.
Barberan "Jetmaster Series Catalogue", Barberan, 8 P., 2020.
Barberan "Jetmaster Series Waveform Configuration File for SEIKO RC1536 and 1024GS", Barberan, 1 P., Sep. 6, 2021.
Barberan "Screenshot User Interface", Barberan, 1 P.
Barberan "Barinsa—Waveform Report", Barberan Jet Master Series, 14 P., Sep. 2020.
Barberan. "Single Pass Jetmaster Series", Barbera, 5 P., 2020.
Barniz Entry in the Online Dictionary of the Spanish Language of the Real Academia, 3.P., Jun. 10, 2020.
Beuth "Paints and Varnishes—Determination of Gloss Value at 20°, 60° and 85° (ISO 2813:2014); German Version EN ISO 2813:2014", Beuth Pubfishing DIN, 2 P., Feb. 2015.
Boards of Appeal of the EPO "Beschwerdekammer/Communication of the Board of Appeal Jun. 19, 2019", Complaint file No. T0665/15-3.2.05.
Boards of Appeal of the European Patent Office "Opinion Board of Appeal", Boards of Appeal of the European Patent Office, English Translation, 22 P., Jun. 19, 2019.

(56) References Cited

OTHER PUBLICATIONS

Dennis van Ijzerloo "Digital Printing Singlepass", DIPA Symposium, English Translation, 35 P., Aug. 7, 2019.
Dreiss Patentanw?lte PartG mbB "Action for Annulament of the DE Part of EP 2313281", Dreiss Patcntanw?ltc PartG mbB. English Translation, 72 P., Oct. 2020.
Dreiss Patentanwälte PartG mbB "Action for annulment of the DE part of EP 2 313 281.Reference number of the action for annulment: 3 Ni 34/20 (EP)", Dreiss Patentanwälte PartG mbB, English Translation, 36 P., Jul. 19, 2021.
Düsseldorf Regional Court "Urteil/Judgemenet" Düsseldorf Regional Court, 25.11.2021-12:20 0211 87565 1260 Regional Court Duesseldorf 3. 3/82, Nov. 25, 2021.
Eladio Jesús "Histogram Tool Description", Barberan, 4 P., Jun. 1, 2021.
Emmler "Neue Entwicklungen bei der Industriellen Beschichtung von Holz und Holzwerkstoffen fuer Innenanwendungen", Technische Universitaet Dresden, Fakultaet Maschinenwese, Institut fuer Holz- und Papiertechnik, Tagungsband des 14. Holztechnologischen Kolloquiums, Dresden, Germany, Apr. 8-9, 2010, Schriftenreihe Holz- und Papiertechnik, 5: 120-125, Apr. 8, 2010.
Epson "Variable Sized Droplet Technology", Epson, 3 P., 2022.
European Standard "Chipboard Definition and classification German version EN 309", European Standard, English Translation, 11 P., Aug. 1992.
Ezzeldin et al. "Improving the Performance of an Inkjet Printhead Using Model Predictive Control," Preprints of the 18th IFAC World Congress, Sep. 2, 2011: 11544-11549.
Federal Patent Court "Nichtigkcitsklagc gegen den DE-Tcil des EP 2 313 281 Aktenzeichen der Nichtigkeitsklage: 3 Ni 34/20 (EP) or Action for annulment of the DE part of EP 2 313 281 Reference number of the action for annulment: 3 Ni 34/20 (EP), In response to the defendant's statement of opposition of Apr. 9, 2021", Jul. 19, 2021.
Finsa "Catalogue", Finsa, 11 P., Mar. 4, 2022.
Finsa "Data Sheet MDF-Board", Finsa, 4 P., 2008.
Global Graphics "Global Graphics News Release ", Global Graphics, 3 P., Jul. 10, 2018.
Global Graphics "How to Mitigate Artifacts in High-Speed Inkjet Printing: a White Paper 4th Edition", Global Graphics, 16 P., Sep. 2019.
Kruss "Client Application Report", Kruss, 12 P., Oct. 20, 2020.
Kruss "Determination of Droplet Sizes with DSAInkjet", Kruss, 4 P., Oct. 20, 2020.
Laminat Magazin "Himmen Prospect", Laminat Magazin, 2 P., 2009.
Li&Co AG "Micodur, Li&Co AG Confirmation of Purchase", Li&Co AG, 2 P., Sep. 8, 2021.
Lintec "Lintec Adhesives and Bonding", Lintec. 2 P., Mar. 2020.
Lintec "Lintec Product Information", Lintec, 4 P., 2020.
Meteor "MetCal for Print Calibration & Nozzle-Out Compensation", Meteor, 2 P., 2022.
Mimura et al. "Micro-Piezoelectric Head Technology of Color Inkjet Printer", International Conference on Digital Production Printing and Industrial Applications, 230-234 P., 2001.
Oji Tac Co.,Ltd. "Oji Tac", product information, Oji Tac Co.,Ltd., retrieved from the internet on Feb. 25, 2022.
PrintFlat "Corrects Inkjet Non-Uniformity Across the Web", PrintFlat, 7 P., Sep. 29, 2021.
Printing Industries of America "2019 Intertech Technology Award", Printing Industries of America, 34 P., 2019.
Real Academia Espanola "Barniz", Diccionario de la Lengua Espanola—Edicion del Tricentanario, Real Academia Espanola, Definition, 3 P., Oct. 11, 2014.
Seiko "508GS Greyscale Series of Printheads", Seiko, 2 P., Sep. 18, 2020.
Seiko "Seiko, 508GS Greyscale Series of Printheads, 2020", Seiko Holdings Group, Sep. 18, 2020.
SII Printek Inc. "Product Lineup—Inkjet Print Head—SII Printek Inc." retrieved from the internet on Mar. 8, 2021.
Toshiba "Brochure of CA3", Toshiba, 2 P., Jan. 12, 2022.
Toyo Ink Europe Specialty Chemicals D26 Liojet UH021-YL-A10, Safety Data Sheet, Toyo Ink Europe Specialty Chemicals, Jan. 3, 2017.
Von Aufschnaiter "Industrial Ceramic Tile Manufacturing", Durst Phototechnik, Slideshow, p. 1-18, Nov. 3, 2014.
Wallace et al. "Photo Realistic Ink Jet Printing ThroughDynamic Spot Size Control", Microfab, 9 P., Jun. 26, 2008.
Wijshoff "The Dynamics of the Piezo Inkjet Printhead Operation", Physics Report, 491(4-5): 77-177, Available Online Mar. 31, 2010.
Wikipedia "Archimedes Theorem about Sphere and Circular Cylinder", Wikipedia, English Translation, 7 P., Mar. 16, 2021.
Wikipedia "Corrugated Fiberboard", Wikipedia, 9 P., 2022.
Wikipedia "Haftone", Wikipedia, 9 P., Retrieved from the Internet on Oct. 4, 2021.
Wikipedia "Holz", Wikipedia, retrieved from the internet on Apr. 8, 2021.
Wikipedia "Inkjet Printing", Wikipedia, p. 1-15, Last Edited Aug. 31, 2020.
Wikipedia "Lintec", Wikipedia, English Translation, 3 P., Feb. 25, 2022.
Wikipedia "Medium-density fibreboard", Wikipedia, retrived from the internet on Jul. 4, 2022.
Wikipedia "Melamine Resin", Wikipedia, retrieved from the internet on Jul. 7, 2022.
Wikipedia "Melaminharz", Wikipedia, retrieved from the internet on Mar. 2, 2022.
Wikipedia "Mitteldichte-Holzfaserplatte", Wikipedia, retrieved from the internet on Mar. 3, 2022.
Wikipedia "Paper", Wikipedia, retrieved from the internet on Jun. 24, 2022.
Wikipedia "Papier", Wikipedia, retrieved from the internet on Apr. 8, 2021.
Wikipedia "Satz des Archimedes ̈ber Kugel und Kreiszylinder" with machine-translation, Wikipedia, retrived from the internet on Mar. 16, 2021.
Wikipedia "Syntetic Paper", Wikipedia, retrieved from the internet on Feb. 25, 2022.
Wikipedia "Ultraviolet", Wikipedia, the Free Encyclopedia, 29 P., Jun. 12, 2017.
Wikipedia "UV Curing", Wikipedia the Free Encyclopedia, 3 P. Apr. 12, 2017.
Wikipedia "Wellpappe, Wikipedia", retrieved from the internet on Apr. 8, 2021.
Wikipedia "Wood, Wikipedia", retrieved from the internet on Jun. 24, 2022.
Wikipedia "Yupo (manufacturer)", wikipedia, retrieved from the internet on Feb. 25, 2022.
Xaar "Operating Parameters for XAAR 1001", Xaar, 7 P., 2008.
Xaar "Press Release Ligna 2009", XAAR, 6 P., May 18-22, 2009.
Xaar "User Manual(Handbuch) XAAR 1001", Xaar, 67 P., 2007.
Xaar—Technologies "The Wayback Machine", Xaar—Technologies, retrieved from the internet on Jun. 9, 2021.
Xaar Technology "Prospekt XAAR 1001", Xaar Technology.
Official Action dated Nov. 25, 2022 from the US Patent and Trademark Office Re. U.S. Appl. No. 16/494,310. (99 pages).
Official Action dated Dec. 5, 2022 from the US Patent and Trademark Office Re. U.S. Appl. No. 17/883,626. (62 pages).
Notice of Allowance dated Mar. 16, 2023 from the U.S. Patent and Trademark Office Re. U.S. Appl. No. 17/883,626. (12 pages).
Official Action dated Mar. 9, 2023 from the U.S. Patent and Trademark Office Re. U.S. Appl. No. 17/467,316. (72 pages).
Official Action Dated Apr. 5, 2023 from the U.S. Patent and Trademark Office Re. U.S. Appl. No. 16/865,356. (18 pages).
Restriction Official Action dated Apr. 26, 2023 from the U.S. Patent and Trademark Office Re. U.S. Appl. No. 18/092,347. (6 pages).

* cited by examiner

METHOD AND APPARATUS FOR PRODUCING A DECORATIVE WORKPIECE AND WORKPIECE

RELATED APPLICATIONS

This application is a Division of U.S. patent application Ser. No. 16/494,308 filed on Sep. 16, 2019, which is a National Phase of PCT Patent Application No. PCT/EP2018/065737 having International filing date of Jun. 13, 2018, which claims the benefit of priority of German Patent Application Nos. 10 2017 113 035.7 and 10 2017 113 036.5, both filed on Jun. 13, 2017, and European Patent Application Nos. 18157511.9 filed on Feb. 19, 2018, 18161725.9 filed on Mar. 14, 2018, 18162382.8 filed on Mar. 16, 2018 and 18168263.4 filed on Apr. 19, 2018. The contents of the above applications are all incorporated by reference as if fully set forth herein in their entirety.

FIELD AND BACKGROUND OF THE INVENTION

The present invention concerns a method and an apparatus for producing a decorative surface and a workpiece.

A decorative surface for furniture, floor panels or wall panels is state of the art. Surfaces of workpieces, such as chipboards or MDF boards, are coated with a decoratively printed paper or printed directly after application of a white primer and provided with a protective lacquer. The surfaces are often replicas of real wood surfaces, stones or tiles. Both the image (decoration) of the wood surface and the tactile "haptic" structure (tactile wood pores and knotholes) are reproduced. The surfaces that are coated can however also include (also for the purposes of the present invention) rolled goods such as printed paper or printed plastic foils.

The optical reproduction of decorative images is produced according to the state of the art using both analogue printing processes and digital printing processes based on a digital image template. To create the haptic, tactile structure with a structure depth of usually 5-500 μm, preferably 10-100 μm, an analogue process, such as embossing with structured embossed plates ("matrices"), is used according to the state of the art. It is also known to produces such structures with digital methods as shown in DE 10 2015 110 236 A1 and DE 10 2009 044 802 A1.

DE 10 2007 055 053 A1 discloses a method for processing a structured surface of an embossing tool ("matrice"), whereby the gloss level of a first coating differs from that of a second coating, for example to better simulate wood pores. When such an embossing tool is subsequently used to produce a finished product, e.g. a floor panel, consisting of an HDF backing board and a printed, melamine-impregnated paper as decorative layer, after pressing with the embossing tool the wood pores printed decoratively in the paper become visible against light at an optical viewing angle of less than 45 degrees, also by differences in the gloss level of the cured melamine surface, moulded from the differently processed surface of the matrice. The production of such an embossing tool is a complex process. Furthermore, the embossing tools are usually used in short-cycle presses, in which the change from one embossing tool to another one takes longer time, at least approx. 15-30 min.

SUMMARY OF THE INVENTION

It is therefore an objective of this invention to create an optically and haptically appealing surface having an optimized structuring. Furthermore, it should be possible to arrange optical and haptic properties on a surface spatially in a suitable way, e.g. to be able to arrange a shiny pore spatially exactly above the optically printed wood pore.

This problem is solved by the features of the independent claims. Advantageous embodiments are subject of the subclaims.

In the method according to the invention, a workpiece, for example a board made of a wood-based material, is first fed to a coating station in order to then apply a first liquid lacquer with a coarse structuring to the entire surface, in which a difference in thickness between thicker regions and thinner regions is at least 50 μm, in particular at least 100 μm, for example between 150 μm and 400 μm.

Preferably, the first lacquer layer with coarse structuring is then at least partially cured. Preferably, a decorative image can then be printed onto this first lacquer layer by multicolour printing. Optionally, the decorative image can also be printed before the first lacquer layer, whereby the first lacquer is then at least partially transparent so that the decorative image remains visible. Alternatively, the workpiece can also be provided with a decorative image at the beginning.

In accordance with the invention, a second liquid, at least partially transparent lacquer is now applied to the lacquer layer with the coarse structuring and, for example, visible decor image to produce a fine structuring in some regions.

Preferably this second lacquer is then cured, whereby the difference in thickness in the region of fine structuring on the second lacquer layer is less than 50 μm, in particular less than 30 μm, for example between 5 μm and 25 μm.

As a result, a visible decorative image is coated with at least two lacquer layers which produce a different structuring on the surface, a coarse structuring with larger differences in thickness and a fine structuring with smaller differences in thickness. This makes the surface optically and haptically less uniform.

Preferably, the gloss level in the region of fine structuring differs by at least 10 gloss units from that in the region of coarse structuring. The gloss level of the first lacquer layer can preferably deviate at least 20 gloss units from the gloss level of the second lacquer layer, whereby the gloss units are measured according to DIN EN ISO 2813:2015-02 at an angle of 60°. In this way, an optically clearly perceptible gloss effect can be perceived. The adjustment of the gloss level during printing can be varied by the droplet size and/or the number of droplets per area or by the use of matting agents.

Gloss is measured according to DIN EN ISO 2813:2015-02. For the gloss measurement, the amount of light reflected by a surface in relation to a reference standard from polished glass is measured. The unit of measurement used here is GU (Gloss Units). The amount of light reflected from the surface depends on the angle of incidence and the properties of the surface. For gloss measurement, different angles of incidence (20°, 60° and 85°) can be used to measure the reflectance, preferably at an angle of incidence of 60°. Alternatively, the mean value of measurements for the three angles of incidence can also be used. The reflectance compares the light energy emitted from and received by a gloss meter in percent at a certain angle of incidence.

All surfaces or sections of surfaces which, according to the standard, achieve less than 20 gloss units when measured with a gloss meter are defined as "matte", and all surfaces or sections of surfaces which achieve more than 60 gloss units are referred to as "glossy". One of both lacquer layers can be matte and the other one glossy.

For a fine adjustment of the gloss level, the droplets of the second lacquer layer are preferably sprayed with a droplet size smaller than 100 pL, in particular smaller than 10 pL. Optionally, different gloss levels can also be applied to the second lacquer layer, so that differences in gloss can also be present within the second lacquer layer.

The first lacquer is preferably applied with at least one printing roller which unrolls on one surface of the workpiece. The printing roller can, for example, be engraved and have an elastic material on an outer surface or an inner ring. Then the engraved roll can unroll directly on the surface of the workpiece. Alternatively, the first lacquer can be applied via at least two rollers, whereby the first lacquer is transferred from a first roller to a second roller, which then transfers the first lacquer to the surface of the workpiece.

The application of the second lacquer to create the fine structuring is preferably carried out by at least one digital print head. As a result, the haptic properties of an optical region of a decorative image can be matched particularly precisely to its spatial location. For example, the fine structuring can be used to imitate a light wood grain that is congruent with the wood grain of the decorative image.

Alternatively or additionally, the second lacquer can also be applied after an initially liquid lacquer has been applied, whereby lacquer droplets of the second lacquer layer are then sprayed into the still liquid material to create a fine structuring. The lacquer droplets can consist of the same material as the liquid layer. The application of a large number of lacquer droplets into the still liquid lacquer layer with digital print heads is done, for example, with lacquer droplets having a volume of less than 10 pL, which are sprayed onto the still liquid lacquer at a speed greater than 1 m/sec.

In an alternative embodiment, the lacquer droplets consist of a different material than the liquid lacquer, which droplets undergo a chemical reaction with the liquid lacquer after impact, which changes the surface optically and/or haptically in the respective regions. Instead of a chemical reaction, the liquid lacquer can also cause a physical reaction by impacting on the liquid lacquer, whereby the sprayed droplets volatilize within less than 5 minutes by evaporation.

The method according to the invention is preferably used for panel-shaped workpieces, especially those made of a wood-based material. However, in an alternative embodiment it is also possible to coat rolled goods instead of a panel-shaped workpiece. For example, these can be decoratively printed paper or a plastic film made of ABS, PP, PE or similar materials. The paper can have a grammage between 20 g/m$^2$ and 300 g/m$^2$. The plastic films can have a thickness of between 0.05 mm and 5 mm. The rolled goods can, for example, be edgebandings that are fixed to the end faces of panel-shaped workpieces in the manufacture of furniture panels.

BRIEF DESCRIPTION OF THE SEVERAL VIEWS OF THE DRAWINGS

In the following the invention is explained in detail by way of the accompanying drawings. These show.

DESCRIPTION OF SPECIFIC EMBODIMENTS OF THE INVENTION

Figure 1:
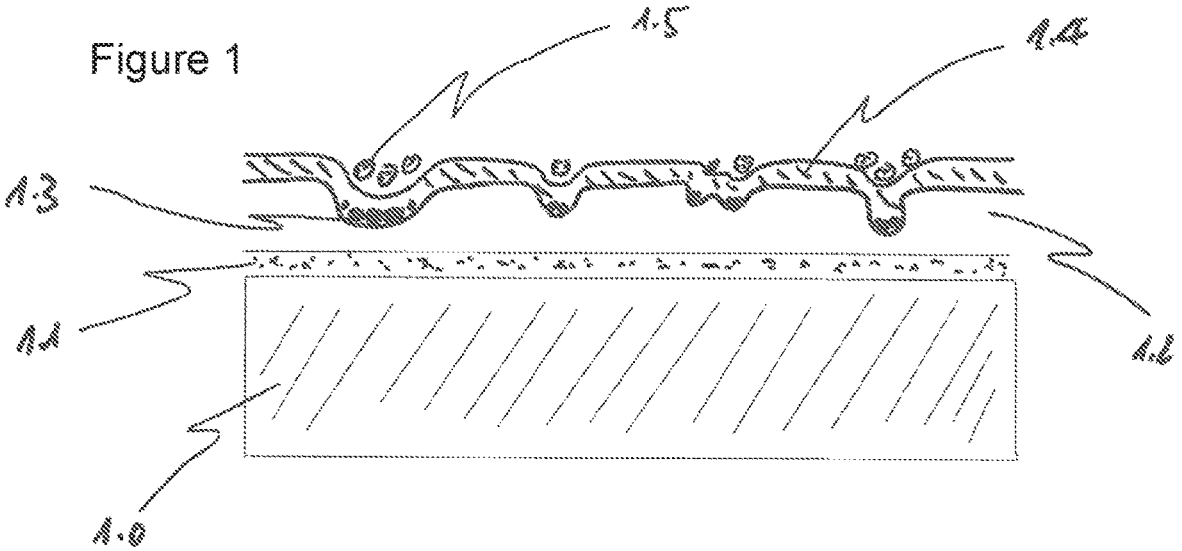
FIG. 1 a schematic cross-sectional view of a plate-shaped workpiece produced by means of the method of the invention.

FIG. 1 shows a plate-shaped workpiece 1.0 on which an optional first base layer 1.1 is provided on one surface. In addition, a decorative image, e.g. a wood reproduction or a tile image, is optionally printed on the workpiece 1.0 before the first base layer 1.1 is applied. In an alternative embodiment, a decorative image can also be printed on after application of the first base layer 1.1 or after application of a structured second base layer 1.2, for example using a four-colour digital printer. A second liquid base layer 1.2 is applied to the first base layer 1.1. This second base layer 1.2 has been structured with digitally sprayed droplets 1.3, so that the surface is no longer flat, but forms a structure and a first lacquer layer with a coarse structuring. Subsequently, a first lacquer layer 1.4 is applied, which has a first gloss level. A second lacquer layer 1.5 is then applied to the first lacquer layer 1.4 by digital print heads in order to create a fine structuring, wherein the second lacquer layer 1.5 only partially covers the surface of the first lacquer layer 1.4.

The lacquer layers 1.4 and 1.5 are cured one after the other or together, for example by UV radiation. After curing, the second lacquer layer 1.5 has a different gloss level than the first lacquer layer.

Instead of structuring the second base layer 1.2 with digitally sprayed droplets, it is also possible to structure a base layer using other methods, for example by applying it only to certain regions or using embossing matrices. It is also possible to apply the decorative image to a structured surface instead of a flat surface.

Figure 2:
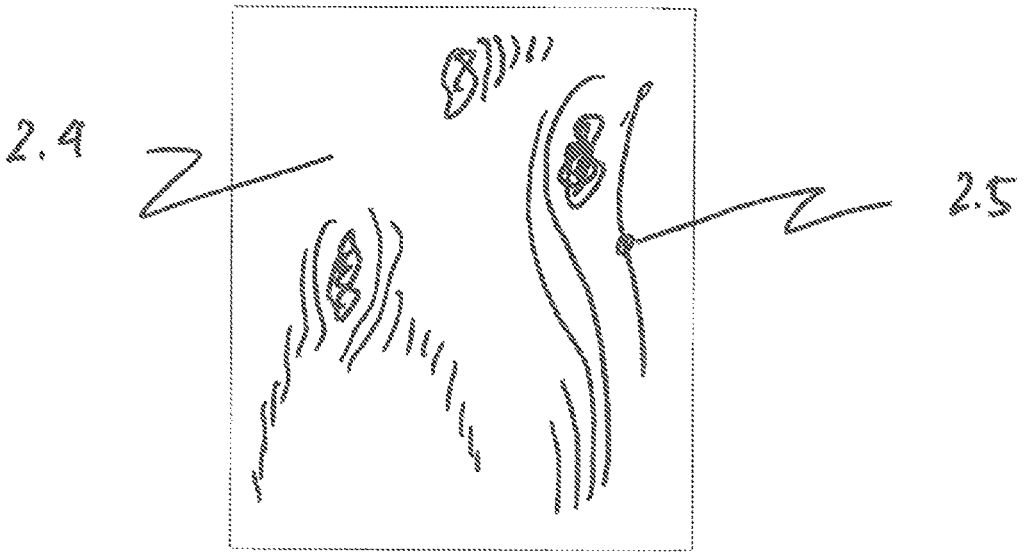
FIG. 2 another schematic illustration of a plate-shaped workpiece produced by means of the method according to the invention with an indicated wood pore in plain view, FIG. 3 a surface of a printed workpiece, and FIG. 4 a view of a workpiece according to the invention having several layers.

FIG. 2 shows a plan view of the plate-shaped workpiece 1.0 of FIG. 1 and it can be seen that the decorative image comprises a wood pore 2.5 and grained wood regions 2.4. The different regions of the wood pore 2.5 and the grained wood regions 2.4 can also have a different gloss level due to the second lacquer layer 1.5, whereby the decorative regions of the image and the different gloss regions are preferably congruent as a result of the lacquer application.

In a further embodiment, a carrier plate made of a wood material, or a plate made of another material with a thickness of at least 4 mm, preferably 8 to 16 mm and external dimensions of at least 200 mm width and at least 400 mm length is first coated with a UV-curing, white base lacquer, for example with an amount of about 20 g/qm. This white base lacquer is then cured under UV irradiation.

The carrier plate is then fed to a digital printing device in which a printed image, for example a reproduction of small tiles as mosaics, a wood decor or another pattern, is applied with a four-color CMYK print.

Figure 3:
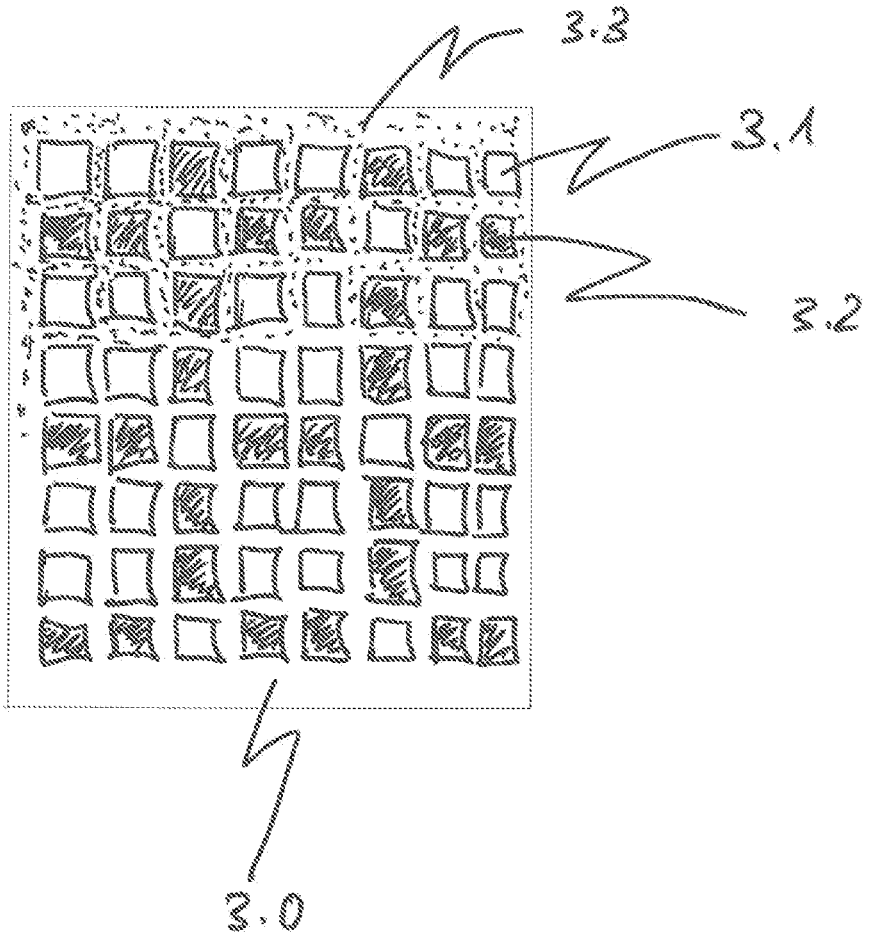

As an example of a printed image FIG. 3 shows a design with two mosaic tiles in different colors, which is printed on a plate-shaped workpiece 3.0, whereby bright mosaic tiles 3.1 and darker mosaic tiles 3.2 are envisaged. In an alternative embodiment a variety of other colors of tiles or mosaics with graphic representations can also be used.

Then a thin base lacquer layer of 5-15 g/sqm of a UV-curing lacquer is applied to the carrier plate printed in this way and (partially) cured with UV light. In an alternative embodiment, this base lacquer layer can be completely omitted or replaced by a solvent lacquer or an aqueous acrylate lacquer, which is then physically dried.

A further base lacquer layer 1.2 is then applied to the first base lacquer layer or alternatively directly to the printed image as a radiation-curing lacquer layer, preferably on an acrylate basis, in a layer thickness of 100-500 μm. The base lacquer layer can be applied by digital print heads or by printing rollers or other processes. Directly after the application of this second base lacquer layer 1.2, a further, transparent lacquer layer 1.3 is printed to the still liquid layer before curing, optionally by means of a digital printing template with digital print heads. When applying this lacquer layer 1.3 the droplet size can vary between 1 pL and 100 pL. The digital printing template used is the one that was also used to print the tile mosaic described above. This printing template is electronically modified beforehand so that only the interspaces 3.3 of the mosaic tiles 3.1 and 3.2 are printed. Then the radiation-curing base lacquer layer 1.2 is cured together with the lacquer layer 1.3 using a UV lamp. In an alternative embodiment, curing can also be performed using electron radiation.

The result is a carrier plate printed with a tile mosaic in which the interspaces 3.3 are recessed by 10-60 μm as joints between the mosaic tiles 3.1 and 3.2.

Subsequently, the gloss level of at least parts of the entire surface is adjusted to the desired value by at least partial application of a second lacquer layer 1.4 with subsequent drying, whereby the gloss level of the first lacquer layer 1.3 deviates from the gloss level of the second lacquer layer.

In an alternative embodiment, the additional application of a third lacquer layer 1.5 can also be carried out before or after the second lacquer layer 1.4 has been cured, wherein the third lacquer layer 1.5 also consists of a large number of droplets with a size of 3-100 pL dispensed onto the surface. With this third lacquer layer, both the gloss level can be changed again in some regions and the surface structure depth of the uncured lacquer layer 1.4 can be influenced.

The lacquer layers 1.4 and 1.5 can also be completely omitted if the gloss level is changed by applying the first lacquer layer 1.3 concomitantly with application of the second base lacquer layer 1.2 for structuring.

The surface of the mosaic tiles 3.1 and 3.2 now has a value of 60 to 90 gloss units, for example, while the gloss level at the interspaces 3.3 is only 20 to 40 gloss units, for example.

Optionally, the gloss level at the interspaces 3.3 can also be reduced by a further lacquer layer, which is subsequently printed into the recessed interspaces by a further digital printing device with a transparent, UV-curing lacquer. Then more than just two lacquer layers are applied to adjust the gloss level.

For printing a rather matte lacquer layer, droplet sizes of 3-6 pL are used, which are cured within 0.5-2 sec after impact on the surface by means of UV LED radiation to such an extent that they can no longer flow. This creates a surface structure in these regions that no longer reflects the incident light in a straight line. The gloss level is thereby reduced to values of 30 gloss units and less.

In the method of the invention, the second lacquer layer can have either a higher or lower gloss level than the first lacquer layer. The gloss level can be adjusted using the following methods, for example:

Option 1:

Matte regions through the first lacquer layer consist of previously (analog or digital) applied matte lacquer, for example with matting agents or by an excimer matting. Glossy regions of the second lacquer layer consist of lacquer applied by digital print heads, which lacquer is formed from a plurality of individual droplets, which results in a very smooth surface in certain regions and thus a high gloss level. The droplets have a size of at least 6 pL, and curing only takes place after a progression phase of at least 1 sec, preferably after more than 5 sec.

Option 2:

The glossy regions of the first lacquer layer consist of previously (analog or digital) applied glossy lacquer, matte regions of the second lacquer layer consist of digitally applied lacquer consisting of a plurality of smallest droplets having a droplet size of less than 8 pL, preferably less than 3 pL, which are at least partially cured within less than 3 seconds after application, preferably less than 1 sec after application.

Both options preferably employ curing by a UV-LED lamp, which is arranged in the direction of throughput within less than 100 mm after the digital print heads, which apply the plurality of droplets to the surface.

Matting agents, such as PE waxes or silicas, can be added to the lacquer to produce a matte lacquer layer. The proportion of matting agents in the lacquer can be between 2% to 6%, in particular 3% to 5% (weight percent).

The different Examples of FIGS. 1 and 3 can be combined with one another as desired with regard to the application and structuring of a layer. The number of layers on the workpiece can also be freely selected, depending on the surface structure to be created with the method.

In alternative embodiments of the method according to the invention, acrylate-containing, UV-curing lacquers used as the lacquers can be replaced by aqueous or solvent-based lacquers. In this case, the steps for UV drying by means of UV LED or UV arc lamp are replaced by physical drying by means of hot air or IR lamps or a combination of both.

Figure 4:
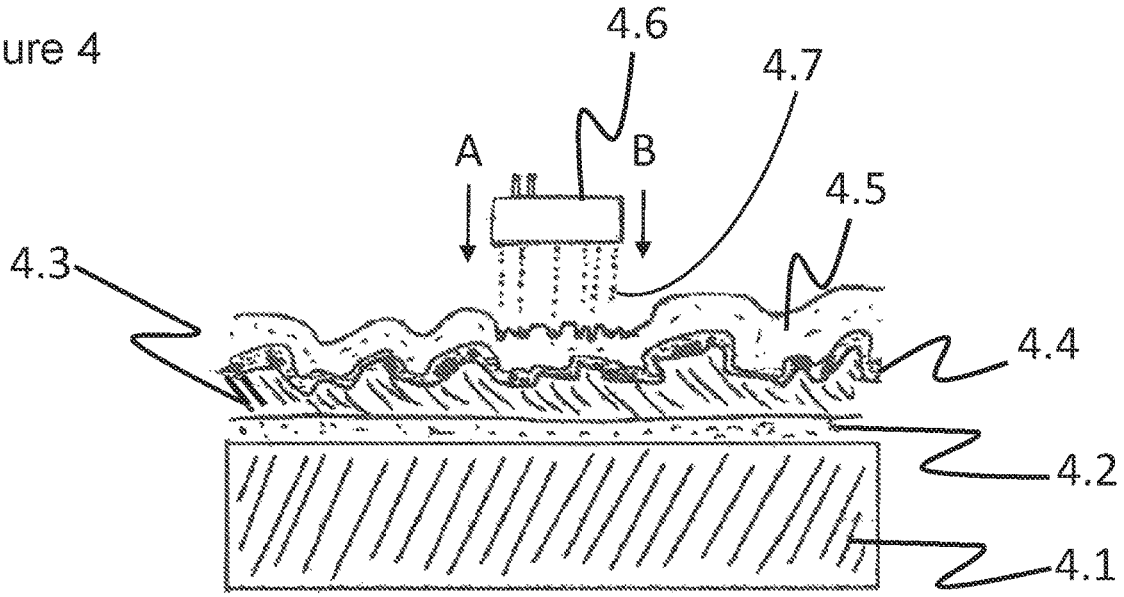

FIG. 4 shows another example of a coated plate-shaped workpiece 4.1.

A workpiece 4.1, for example a board made of a wood-based material with a width of 200 to 2000 mm and a length between 500 and 3000 mm as well as a thickness between 8 mm and 18 mm is fed to a coating station. The workpiece 4.1 is already printed with a decor image, such as a wood reproduction, e.g. an oak decor.

In the coating station, a plain intermediate lacquer layer 4.2, such as an adhesion base or primer, is optionally applied. A laser-engraved rubber roller is then used to apply a radiation-curing, transparent first lacquer layer 4.3 ranging from 100 to 200 g/m$^2$ to the workpiece 4.1 whereby the engraving in the rubber roller creates the structure of a coarse wood pore on the surface. The height differences between the "pore valleys" and the elevations, i.e. the differences in thickness of the first lacquer layer 4.3, are between 150 μm and 300 μm (micrometers) and form a coarse structure. Subsequently, the applied lacquer is cured with a UV lamp. In an alternative embodiment, a decorative image 4.4 can be printed on the structured surface using a digital printer with 4-color printing after curing, if there was no image on the workpiece before the coating. In this case, the lacquer layer 4.3 can also be coloured, for example white.

A further liquid lacquer layer 4.5 is applied to the now cured lacquer layer 4.3 with or without the coloured decorative printing layer 4.4 in a further coating station by means of a smooth rubber roller. The workpiece is then fed to a digital printing station 4.6, where a large number of droplets 4.7 is applied to the still liquid lacquer layer 4.5 based on a digital image template, which provide the still liquid lacquer layer 4.5 with a fine structuring. The digital image template is matched to the previously printed decorative image, e.g. rustic oak, in such a way that the visually recognisable image components, such as a knot hole or a black printed crack in the wood, correspond exactly spatially with the structure printed into the liquid pore. Thus the end user can also feel the optically printed knothole. At the same time the very deep and coarse structure from lacquer layer 4.3 lies above all, emphasising the rustic character of the oak reproduction.

Finally, several aspects of the present invention are described.

A first aspect of the invention is a method of manufacturing a decorative workpiece with a textured surface comprising the following steps:

A feeding the workpiece to a coating station;

B applying a first liquid lacquer having a coarse structuring over the entire surface, wherein a difference in thickness between thicker regions and thinner regions is at least 50 μm, in particular at least 100 μm;

C at least partially curing the applied first lacquer;

D applying a decorative image using multicolour printing before step B or after step C;

E applying a second liquid, at least partially transparent lacquer for producing a fine structuring in certain regions;

F curing of the second lacquer, wherein the difference in thickness in the region of the fine structuring of the second lacquer layer is less than 50 μm, in particular less than 30 μm.

A second aspect of the method according to the first aspect is that the gloss level in the region of fine structuring differs by at least 10 gloss units as compared to the region of coarse structuring.

A third aspect of the method according to the first or second aspect is that the application of the first lacquer is carried out with at least one printing roller that unrolls on a surface of the workpiece.

A fourth aspect of the method according to one of the previous aspects is that the second lacquer is applied by at least one digital print head.

A fifth aspect of the method according to one of the previous aspects is that the material for the first and second lacquer is identical.

A sixth aspect of the method according to one of the previous aspects is that in order to produce the second lacquer layer, a liquid lacquer is first applied and then lacquer droplets of the second lacquer layer are sprayed into the still liquid material to produce a fine structuring.

A seventh aspect of the method according to the sixth aspect is that the lacquer droplets consist of the same material as the liquid layer.

An eighth aspect of the method according to the sixth or seventh aspect is that the application of a plurality of lacquer droplets into the still liquid lacquer layer is carried out by means of digital print heads, wherein each lacquer droplet has a volume of less than 10 pL, and the speed of each lacquer droplet when impacting the still liquid lacquer layer is greater than 1 m/sec.

A ninth aspect of the method according to the sixth aspect is that the lacquer droplets consist of a different material than the liquid lacquer and after impact they undergo a chemical reaction with the liquid lacquer, which changes the surface optically and/or haptically at the respective locations.

A tenth aspect of the method according to the sixth aspect is that the lacquer droplets consist of a different material than the liquid lacquer and after a physical reaction due to impact onto the liquid lacquer they volatilize within less than 5 minutes by evaporation.

An eleventh aspect of the method according to one of the previous aspects is that at least one intermediate layer is applied between the workpiece and the first lacquer layer.

Another aspect of the invention is an apparatus for performing the method according to one of the preceding aspects with:

A a coating station and a device for feeding the workpiece to the coating station;

B a first printing station for applying a first liquid lacquer with a coarse structuring to the workpiece over the entire surface area, in which a difference in thickness between thicker regions and thinner regions is at least 50 μm, in particular at least 100 μm;

C a station for at least partial curing the first lacquer;

D a station for applying a second liquid, at least partially transparent lacquer for producing a fine structuring in some regions, and E a station for curing the second lacquer, wherein the difference in thickness in the region of the fine structuring on the second lacquer layer is less than 50 μm, in particular less than 30 μm.

A further aspect of the invention is a workpiece, in particular a plate-shaped workpiece, comprising a wooden workpiece, a carrier material on which at least one decorative image is printed, and at least one lacquer layer having a coarse structuring, in which a difference in thickness between thicker regions and thinner regions is at least 50 μm, in particular at least 100 μm, and at least one second lacquer layer comprising an at least partially transparent material having a fine structuring, in which the difference in thickness is less than 50 μm, in particular less than 30 μm.

A further aspect of the workpiece according to the preceding aspect is that the first lacquer layer has a layer thickness between 100 and 500 μm.

A third aspect of the workpiece according to one of the two previous aspects is that the second lacquer layer has a layer thickness between 10 and 100 μm.

LIST OF REFERENCE SIGNS

1.0 Workpiece
1.1 First base layer
1.2 Second base layer
1.3 Digitally sprayed droplets
1.4 First lacquer layer
1.5 Second lacquer layer
2.4 Grained wood areas
2.5 Wood pore
3.0 Workpiece
3.1 Light-coloured mosaic tiles
3.2 Darker mosaic tiles
3.3 Interspaces
4.1 Workpiece
4.2 Intermediate lacquer layer, e.g. adhesion base/primer
4.3 Analogously applied textured lacquer
4.4 Digital decor printing
4.5 Liquid lacquer layer
4.6 Digital printing station
4.7 Droplets

What is claimed is:

1. An apparatus for performing a method for producing a decorative workpiece with a structured surface comprising the following steps:

applying a first liquid lacquer having a coarse structuring over the entire surface, wherein a difference in thickness between thicker regions and thinner regions is at least 50 μm, in particular at least 100 μm; and applying a second liquid, at least partially transparent, lacquer for producing a fine structuring in some regions, the apparatus comprising:

a coating station for applying the first liquid lacquer with the coarse structuring to the workpiece over the entire surface, in which a difference in thickness between thicker regions and thinner regions is at least 50 μm, in particular at least 100 μm; and a station for applying the second liquid, at least partially transparent, lacquer for producing the fine structuring in some regions wherein the coating station comprises at least one printing roller, and the at least one printing roller is configured to unroll the first lacquer on a surface of the workpiece, and/or in that the apparatus comprises a device for feeding the workpiece to the coating station, and the device for feeding the workpiece to the coating station is configured to feed the workpiece to the coating station, and/or in that the apparatus comprises a station for at least partially curing the first lacquer, and the station for at least partially curing the first lacquer is configured to at least partial cure the applied first lacquer, and/or in that the apparatus comprises a station for curing the second lacquer, and the station for curing the second lacquer is configured to cure the second lacquer, wherein the difference in thickness in the region of fine structuring on the second lacquer layer is less than 50 μm, in particular less than 30 μm.

2. The apparatus according to claim 1, wherein the station for applying the second lacquer is configured to provide a gloss level in the regions of the fine structuring different by at least 10 gloss units as compared to the gloss level in the region of the coarse structuring.

3. The apparatus according to claim 1, wherein the apparatus comprises at least one digital print head, and the at least one digital print head is configured to apply the second lacquer.

4. The apparatus according to claim 1, wherein the apparatus is configured to provide the identical material for the first and the second lacquer.

5. The apparatus according to claim 1, wherein the coating station is configured to apply at least one intermediate layer between the workpiece and a layer of the first lacquer.

6. An apparatus for performing a method for producing a decorative workpiece with a structured surface comprising the following steps:

applying a first liquid lacquer having a coarse structuring over the entire surface, wherein a difference in thickness between thicker regions and thinner regions is at least 50 μm, in particular at least 100 μm; and applying a second liquid, at least partially transparent, lacquer for producing a fine structuring in some regions, the apparatus comprising:

a coating station for applying the first liquid lacquer with the coarse structuring to the workpiece over the entire surface, in which a difference in thickness between thicker regions and thinner regions is at least 50 μm, in particular at least 100 μm; and a station for applying the second liquid, at least partially transparent, lacquer for producing the fine structuring in some regions wherein the station for applying the second lacquer is configured to first apply a liquid lacquer to produce the second lacquer layer and then to spray lacquer droplets of the second lacquer layer into the still liquid material to produce a fine structuring.

7. The apparatus according to claim 6, wherein the station for applying the second lacquer is configured to provide the lacquer droplets made of the same material as the liquid layer.

8. The apparatus according to claim 6, wherein the station for applying the second lacquer comprises digital print heads, and the digital print heads are configured to apply a plurality of lacquer droplets onto the still liquid lacquer layer, wherein each lacquer droplet has a volume of less than 10 pL, and the velocity of each lacquer droplet upon impact on the still liquid lacquer layer is greater than 1 m/sec.

9. The apparatus according to claim 6, wherein the station for applying the second lacquer is configured to provide the lacquer droplets consisting of a material other than the liquid lacquer and undergo a chemical reaction with the liquid lacquer after impact, which changes the surface optically and/or haptically at the respective locations.

10. The apparatus according to claim 6, wherein the station for applying the second lacquer is configured to provide the lacquer droplets consisting of a different material than the liquid lacquer and after a physical reaction due to the impact on the liquid lacquer they volatilize within less than 5 minutes by evaporation.

11. An apparatus for performing a method for producing a decorative workpiece with a structured surface comprising the following steps:

applying a first liquid lacquer having a coarse structuring over the entire surface, wherein a difference in thickness between thicker regions and thinner regions is at least 50 μm, in particular at least 100 μm; and applying a second liquid, at least partially transparent, lacquer for producing a fine structuring in some regions, the apparatus comprising:

a coating station for applying the first liquid lacquer with the coarse structuring to the workpiece over the entire surface, in which a difference in thickness between thicker regions and thinner regions is at least 50 μm, in particular at least 100 μm; and a station for applying the second liquid, at least partially transparent, lacquer for producing the fine structuring in some regions, the apparatus further comprising:

an application device configured to apply a decorative image to the workpiece and/or one of the applied lacquer layers, wherein the application device comprises in particular a multicolour digital printer, and/or a coating station and/or a device for feeding the workpiece to the coating station, and/or a station for at least partial curing of the first lacquer, and/or a station for curing the second lacquer, wherein the difference in thickness in the region of the fine structuring of the second lacquer layer is less than 50 μm, in particular less than 30 μm.

12. The apparatus according to claim 11, wherein the multicolour printer is configured to provide a further step (D) in which a decorative image is applied by multicolour printing before step (B) in which the first liquid lacquer having a coarse structuring over the entire surface is applied, wherein a difference in thickness between thicker regions and thinner regions is at least 50 μm, in particular at least 100 μm, or after the applied first lacquer is at least partially cured.

* * * * *